US011031154B2

(12) United States Patent
Hayakawa et al.

(10) Patent No.: US 11,031,154 B2
(45) Date of Patent: Jun. 8, 2021

(54) COMPOSITE CABLE AND COMPOSITE HARNESS

(71) Applicant: Hitachi Metals, Ltd., Tokyo (JP)

(72) Inventors: Yoshikazu Hayakawa, Tokyo (JP); Tomoyuki Murayama, Tokyo (JP); Hirotaka Eshima, Tokyo (JP); Takahiro Futatsumori, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/694,319

(22) Filed: Nov. 25, 2019

(65) Prior Publication Data

US 2020/0185128 A1 Jun. 11, 2020

(30) Foreign Application Priority Data

Dec. 7, 2018 (JP) ..... JP2018-229647

(51) Int. Cl.

| | |
|---|---|
| ***H01B 11/04*** | (2006.01) |
| ***H01B 7/00*** | (2006.01) |
| ***H01B 9/00*** | (2006.01) |
| ***H01B 11/02*** | (2006.01) |

(52) U.S. Cl.

CPC ..... *H01B 11/04* (2013.01); *H01B 7/0009* (2013.01); *H01B 9/003* (2013.01)

(58) Field of Classification Search

CPC ..... B60R 16/0207; H01B 1/026; H01B 5/08; H01B 7/0009; H01B 7/0045; H01B 7/18; H01B 7/00; H01B 7/17; H01B 9/003; H01B 9/00; H01B 11/04; H01B 11/02; H01B 13/0207; H01B 13/02

USPC ..... 174/113 R, 126

See application file for complete search history.

(56) References Cited

U.S. PATENT DOCUMENTS

2008/0156516 A1* 7/2008 Watanabe ..... H01B 7/16 174/98
2011/0280527 A1* 11/2011 Tamura ..... G02B 6/4433 385/101
2015/0187465 A1* 7/2015 McErlean ..... H01B 11/1813 174/28
2017/0287590 A1* 10/2017 Hayakawa ..... B60R 16/0231

(Continued)

FOREIGN PATENT DOCUMENTS

JP 2006351322 A * 12/2006 ..... H01B 7/17
JP 2017-76515 A 4/2017

*Primary Examiner* — Timothy J Thompson
*Assistant Examiner* — Guillermo J Egoavil
(74) *Attorney, Agent, or Firm* — Roberts Calderon Safran & Cole P.C.

(57) ABSTRACT

A composite cable includes a twisted assembly including a pair of first single core wires and first and second multicore wires that are each arranged in one or the other of regions facing each other across a center plane passing through the central axes of the pair of first single core wires, include an electric wire with a solid (non-hollowed) structure including a first or second twisted pair wire formed by twisting a pair of second or third single core wires with a smaller cross-sectional area than the first single core wire and a first or second inner sheath covering the first or second twisted pair wire so as to fill a space between the pair of second or third single core wires, and have an outer diameter that is not less than 70% and not more than 160% of the outer diameter of the first single core wire.

9 Claims, 5 Drawing Sheets

(56) References Cited

U.S. PATENT DOCUMENTS

2018/0281706 A1 10/2018 Kobayashi
2019/0077341 A1* 3/2019 Kohori ..... H01B 11/02

* cited by examiner

COMPOSITE CABLE AND COMPOSITE HARNESS

CROSS-REFERENCE TO RELATED APPLICATIONS

The present application is based on Japanese patent application No. 2018-229647 filed on Dec. 7, 2018, the entire contents of which are incorporated herein by reference.

TECHNICAL FIELD

The invention relates to a composite cable and a composite harness, in particular, to a composite cable and a composite harness which are routed from a vehicle body to a wheel.

RELATED ART

In recent years, composite cables used for wiring from, e.g., a vehicle body to a wheel have been proposed (see, e.g., JP 2017/76515 A).

The composite cable described in JP 2017/76515 A is provided with a twisted assembly formed by twisting a first twisted pair wire, a second twisted pair wire and a pair of first electric wires together, and a sheath covering the outer surface of the twisted assembly.

In the cross section of the composite cable, the first twisted pair wire is arranged on one side of the center line connecting the centers of the pair of first electric wires, and the second twisted pair wire is arranged on the other side of the center line.

SUMMARY OF INVENTION

In the composite cable disclosed in JP 2017/76515 A, however, when a distance along a longitudinal direction between two corresponding points at Which any of electric wires constituting the first twisted pair wire is located at the same position in a circumferential direction of the first twisted pair wire (hereinafter, also referred to as "twist pitch") is different from a twist pitch of the second twisted pair wire or when the twist phase is different between the first twisted pair wire and the second twisted pair wire, the outer shape of the twisted assembly, i.e., the cross-sectional shape of the twisted assembly may change along the longitudinal direction of the composite cable.

It is an object of the invention to provide a composite cable and a composite harness in which change in outer shape of a twisted assembly along a longitudinal direction of the composite cable can be prevented even when a twist pitch of a first twisted pair wire is different from a twist pitch of a second twisted pair wire or the twist phase is different between the first twisted pair wire and the second twisted pair wire.

According to an embodiment of the invention, a composite cable defined in [1] to [7] below and a composite harness defined in [8] to [9] below will be provided.

[1] A composite cable (1), comprising: a pair of first single core wires (10); a first multicore wire (20) that is arranged in one of regions facing each other across a center plane passing through the central axes (0) of the pair of first single core wires (10), comprises an electric wire with a solid (non-hollowed) structure comprising a first twisted pair wire (210A) formed by twisting a pair of second single core wires (210) with a smaller cross-sectional area than the first single core wire (10) and a first inner sheath (220) covering the first twisted pair wire (210A) so as to fill a space between the pair of second single core wires (210), and has an outer diameter that is not less than 70% and not more than 160% of the outer diameter of the first single core wire (10); and a second multicore wire (30) that is arranged in the other of the regions facing each other across the center plane passing through the central axes (0) of the pair of first single core wires (10), comprises an electric wire with a solid (non-hollowed) structure comprising a second twisted pair wire (310A) formed by twisting a pair of third single core wires (310) with a smaller cross-sectional area than the first single core wire (10) and a second inner sheath (320) covering the second twisted pair wire (310A) so as to fill a space between the pair of third single core wires (310), and has an outer diameter that is not less than 70% and not more than 160% of the outer diameter of the first single core wire (10), wherein a twisted assembly (1A) is formed by twisting the pair of first single core wires (10), the first multicore wire (20) and the second multicore wire (30) together.

[2] The composite cable (1) according to [1], wherein the pair of second single core wires (210) and the pair of the third single core wires (310) comprise signal lines for rotational speed sensors (104A) that detect a rotational speed, and the rotational speed sensors (104A) are respectively attached to end portions of the pair of second single core wires (210) and the pair of the third single core wires (310).

[3] The composite cable (1) according to [1] or [2], wherein a binding tape (40) is provided around the twisted assembly (1A).

[4] The composite cable (1) according to any one of [1] to [3], wherein an outer sheath (50) is provided around the binding tape (40).

[5] The composite cable (1) according to any one of [1] to [4], wherein the first single core wire (10) comprises a conductor (11) formed by twisting a plurality of equal-diameter strands together.

[6] The composite cable (1) according to any one of [1] to [5], wherein the outer diameter of the first multicore wire (20) and the outer diameter of the second multicore wire (30) are not less than 85% and not more than 145% of the outer diameter of the pair of first single core wire (10).

[7] The composite cable (1) according to any one of [1] to [6], wherein the first multicore wire (20) and the second multicore wire (30) are identical.

[8] A composite harness (6), comprising:

the composite cable (1) according to any one of [1] to [7]; and a connector (61) attached to an end portion of the pair of first single core wires (10).

[9] The composite harness (6) according to [8], wherein the first multicore wire (20) and the second multicore wire (30) are arranged at a distance from each other.

Effects of Invention

According to an embodiment of the invention, a composite cable and a composite harness can be provided in which change in outer shape of a twisted assembly along a longitudinal direction of the composite cable can be prevented even when a twist pitch of a first twisted pair wire is different from a twist pitch of a second twisted pair wire or the twist phase is different between the first twisted pair wire and the second twisted pair wire.

DESCRIPTION OF EMBODIMENTS

Embodiment

An embodiment of the invention will be described in reference to the appended drawings. The embodiment below is described as a preferred example for implementing the invention. Although some part of the embodiment specifically illustrates various technically preferable matters, the technical scope of the invention is not limited to such specific aspects. In addition, a scale ratio of each constituent element in each drawing is not necessarily the same as the actual scale ratio of the composite cable and the composite harness.

(Vehicle in which the Composite Cable is Used)

Figure 1:
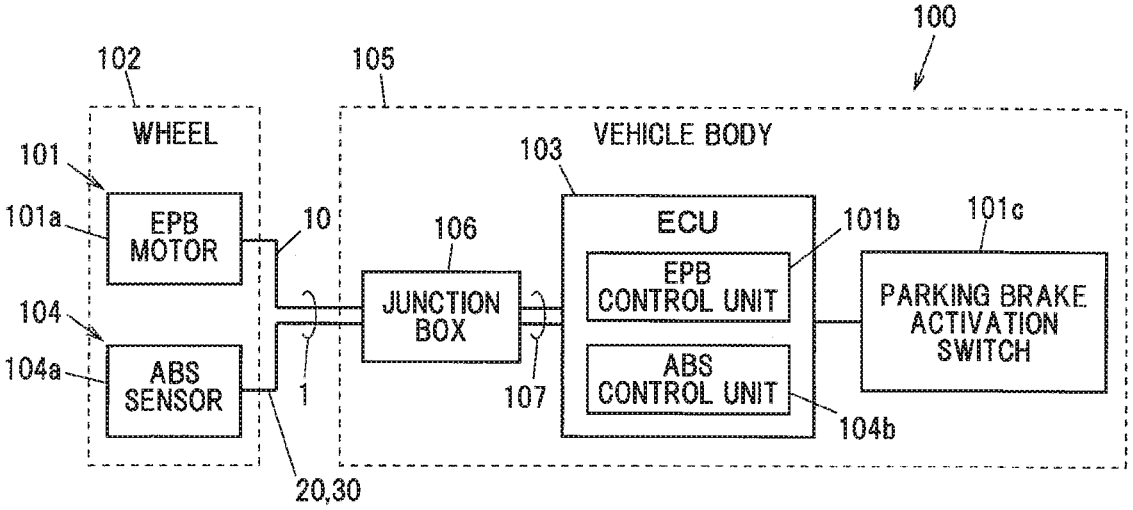
FIG. 1 is a block diagram illustrating an exemplary configuration of a vehicle in which a composite cable in an embodiment of the present invention is used.

FIG. 1 is a block diagram illustrating a configuration of a vehicle in which a composite cable in the present embodiment is used. As shown in FIG. 1, a vehicle 100 is provided with an electric parking brake (hereinafter, also referred to as "EPB") 101 as an electrically operated brake unit. The EPB 101 is provided with an EPB motor 101*a* and an EPB control unit 101*b*.

The EPB motor 101*a* is mounted on a wheel 102 of the vehicle 100. The EPB control unit 101*b* is mounted on an ECU (electronic control unit) 103 of the vehicle 100. Alternatively, the control unit 101*b* may be mounted on a control unit other than the ECU 103, or may be mounted on a dedicated hardware unit.

The EPB motor 101*a* is provided with a piston to which brake pads are attached even though it is not illustrated, and it is configured that the piston moved by rotary drive of the EPB motor 101*a* presses the brake pads against a disc rotor of a wheel (the wheel 102) to generate a braking force. A pair of first electric wires 10 as power lines (see FIG. 2) are connected to the EPB motor 101.*a* to supply a drive current to the EPB motor 101*a*.

The EPB control unit 101*b* is configured to output a drive current to the EPB motor 101*a* for a predetermined period of time (e.g., for 1 second) when a parking brake activation switch 101*c* is turned from an OFF' state to an ON state during the stationary state of the vehicle 100 so that the brake pads are pressed against the disc rotor of the wheel 102 and a braking force to be applied to the wheel 102 is generated.

The EPB control unit 101*b* is configured to output a drive current to the EPB motor 101*a* also when the parking brake activation switch 101*c* is turned from the ON state to the OFF state or when an accelerator pedal is depressed so that the brake pads move away from the disc rotor of the wheel and the braking force on the wheel 102 is released.

In other words, it is configured that an operating state of the EPB 101 is maintained from when the parking brake activation switch 101*c* is turned on to when the parking brake activation switch 101*c* is turned off or the accelerator pedal is depressed. The parking brake activation switch 101*c* may be a switch of either a lever-type or pedal-type.

An ABS device 104 is also mounted on the vehicle 100. The ABS device 104 is provided with an ABS sensor 104*a* and an ABS control unit 104*b*. The ABS sensor 104*a* is an example of the rotational speed sensor.

The ABS sensor 104*a* is mounted on the wheel 102 to detect a rotation speed of the wheel 102 during motion of the vehicle. The ABS control unit 104*b* is mounted on the ECU 103 to control the EPB 101 based on an output of the ABS sensor 104*a* to adjust a braking force applied to the wheel 102 so that the wheel 102 is not locked when suddenly stopped. Second electric wires 210 and third electric wires 310 (see FIG. 2) as signal lines are connected to the ABS sensor 104*a*.

Figure 2:
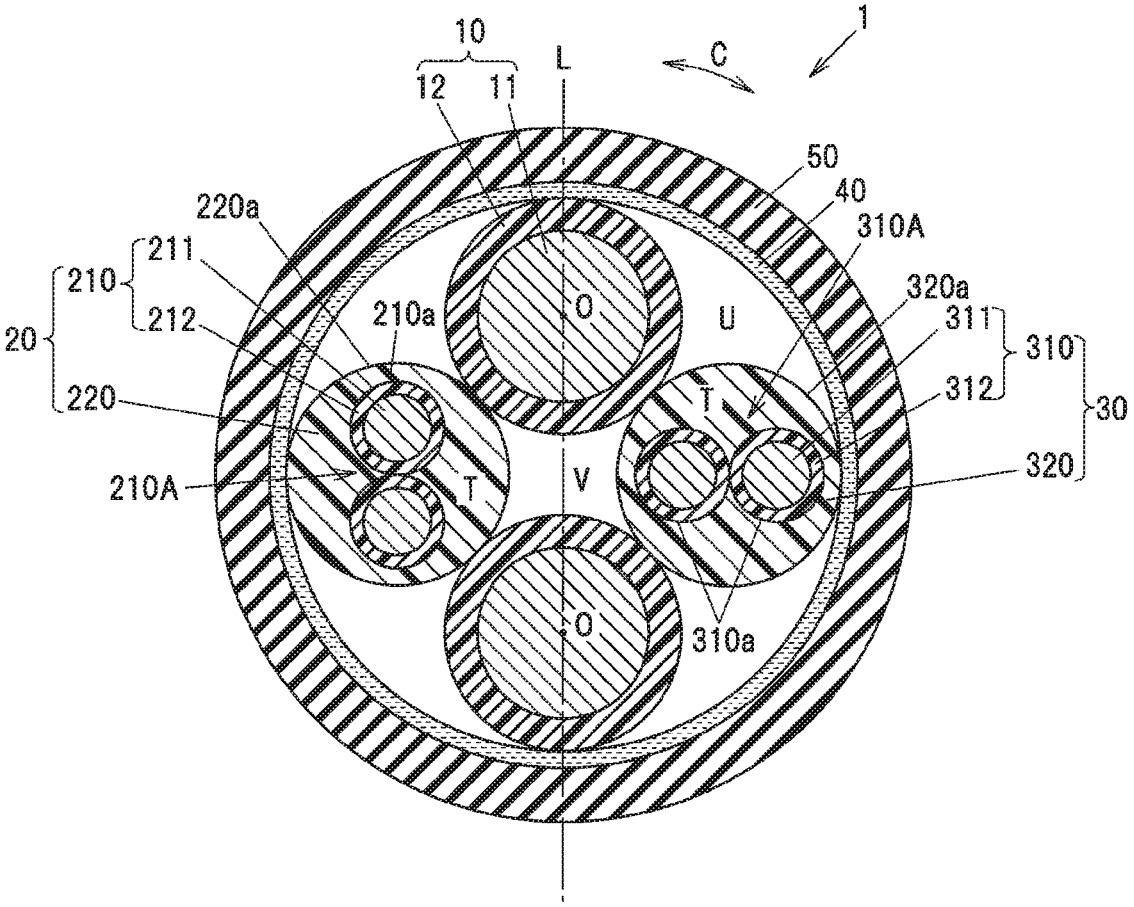
FIG. 2 is a cross sectional view showing an exemplary configuration of the composite cable in the embodiment of the invention.

A composite cable 1 in the present embodiment is obtained by covering all of the first electric wires 10, a first multicore wire 20 and a second multicore wire 30 with an outer sheath 5 (see FIG. 2). The composite cable 1 extending out of the wheel 102 side is connected to a wire group 107 inside a junction box 106 provided on a vehicle body 105 and is then connected to the ECU 103 and a battery (not shown) via the wire group 107.

Although only one wheel 102 is shown in FIG. 1 to simplify the drawing, the EPB motor 101*a* and the ABS sensor 104*a* may be mounted on each of the wheels 102 of the vehicle 100, or may be mounted on, e.g., only front wheels or only rear wheels of the vehicle 100.

(Composite Cable 1)

Figure 3:
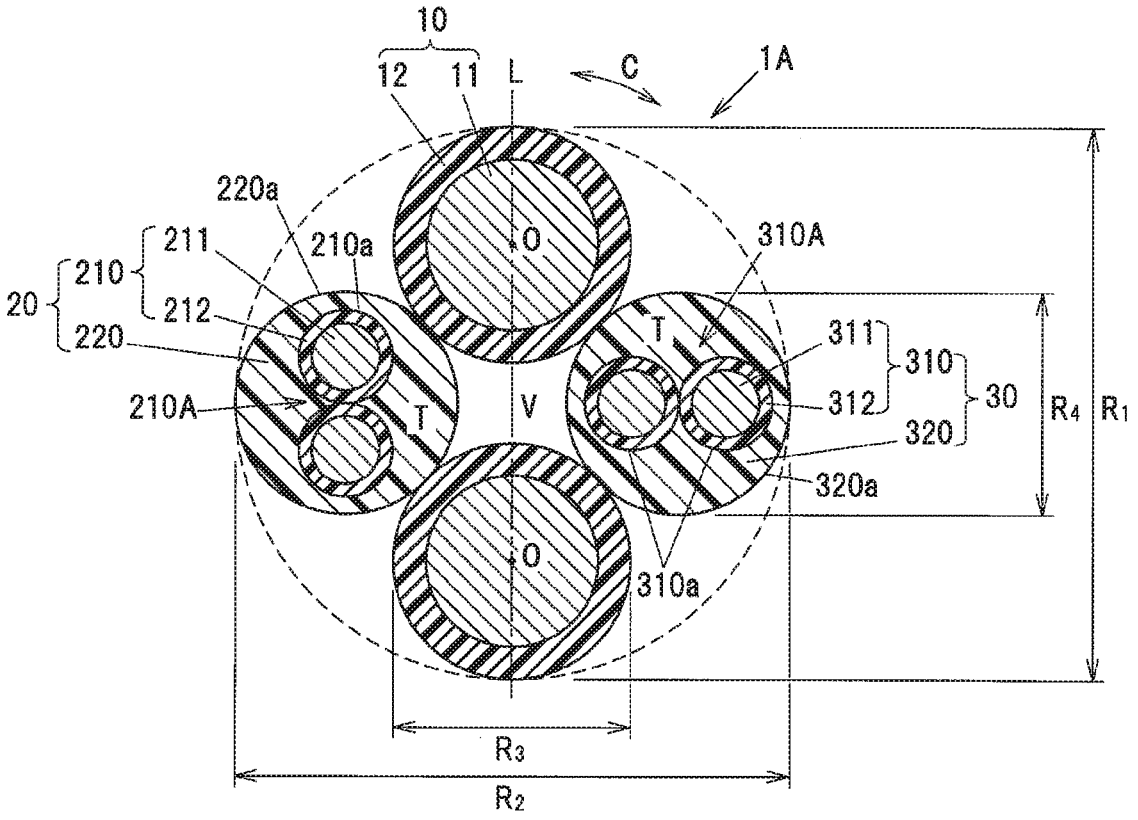
FIG. 3 is a cross sectional view showing a twisted assembly extracted from the composite cable shown in FIG. 2.

The composite cable 1 in the present embodiment will be described in reference to FIGS. 2 and 3. FIG. 2 is a cross sectional view showing an exemplary configuration of the composite cable 1 in the embodiment of the invention. FIG. 3 is a cross sectional view showing a twisted assembly extracted from the composite cable 1 shown in FIG. 2. As shown in FIGS. 2 and 3, the composite cable 1 is provided with the pair (two) of first electric wires 10, the first multicore wire 20 configured to include a first twisted pair wire 210A formed by twisting the pair (two) of second electric wires 210 having a smaller outer diameter than the first electric wires 10, the second multicore wire 30 configured to include a second twisted pair wire 310A formed by twisting the pair (two) of third electric wires 310 having a smaller outer diameter than the first electric wires 10, a tape member 40 spirally wound around a twisted assembly 1A which is formed by twisting the pair of first electric wires 10, the first multicore wire 20 and the second multicore wire 30 together, and an outer sheath 50 provided to cover the periphery of the tape member 40.

The composite cable 1 has six electric wires in total, as described above. The first electric wire 10 is an example of the first single core wire. The second electric wire 210 is example of the second single core wire. The third electric wire 310 is an example of the third single core wire.

(First Electric Wire 10)

In the present embodiment, the first electric wire 10 is constructed of a power line for supplying a drive current to the motor 101*a* for the EPB 101 mounted on the wheel 102 of the vehicle 100. The first electric wire 10 is configured such that a first conductor 11 formed by twisting equal-diameter strands together is covered with a first insulation 12 formed of, e.g., an insulating resin such as cross-linked polyethylene. The strand is formed of, e.g., a highly conductive material such as copper. "Equal" of "equal-diameter" not only means completely the same but also means to include a small error which occurs during, e.g., manufacturing of the strands. The small error refers to, e.g., an error of not more than 5%. The first conductor 11 is an example of the conductor.

Strands having a diameter of not less than 0.05 mm and not more than 0.30 mm can be used to form the first conductor 11. When using strands having a diameter of less than 0.05 mm, sufficient mechanical strength may not be obtained, causing a decrease in flex resistance. When using strands having a diameter of more than 0.30 mm, flexibility of the composite cable 1 may decrease.

The outer diameter of the first conductor 11 and the thickness of the first insulation 12 are appropriately adjusted according to magnitude of required drive current. For example, considering that the first electric wire 10 is a power line for supplying a drive current to the motor 101*a* for the EPB 101, the outer diameter of the first conductor 11 is preferably set to not less than 1.5 mm and not more than 3.0 mm.

(First Multicore Wire 20)

The second electric wire 210 is constructed of a signal line for the ABS sensor 104*a* mounted on the wheel 102, The first multicore wire 20 is configured to include the first twisted pair wire 210A formed by twisting the pair (i.e., two) of second electric wires 210 together, and a first inner sheath 220 provided to cover the periphery of the first twisted pair wire 210A.

The second electric wire 210 is configured such that a second conductor 211 formed by twisting highly conductive strands of copper, etc., is covered with a second insulation 212 formed of an insulating resin such as cross-linked polyethylene. Strands having a diameter of not less than 0.05 mm and not more than 0.30 mm can be used to form the second conductor 211, in the same manner as the strands used to form the first conductor 11.

The outer diameter of the second electric wire 210 is smaller than that of the first electric wire 10. From the viewpoint of making the outer diameter of the composite cable 1 close to a circular shape, it is desirable to use the second electric wire 210 which is about half the outer diameter of the first electric wire 10. In detail, it is possible to use the second electric wire 210 which has an outer diameter of not less than 1.0 mm and not more than 1.8 mm and is formed using the second conductor 211 having an outer diameter of not less than 0.4 mm and not more than 1.0 mm.

Furthermore, from the viewpoint of making the outer shape of the composite cable 1 close to a circular shape in cross section, the outer diameter of the first multicore wire 20 is preferably not less than 70% and not more than 160% of the outer diameter of the first electric wire 10. The outer diameter of the first multicore wire 20 is more preferably not less than 85% and not more than 145% of the outer diameter of the first electric wire 10. When, e.g., the outer diameter $R_3$ of the first electric wire 10 is about 3 mm, the outer diameter $R_4$ of the first multicore wire 20 is preferably about not less than 2.10 mm and not more than 4.80 mm (more preferably, not less than 2.55 mm and not more than 4.35 mm).

The first inner sheath 220 has a substantially-cylindrical outer circumferential surface 220*a* and covers the outer surface of the first twisted pair wire 210A. The first inner sheath 220 is formed of, e.g., a urethane-based resin such as thermoplastic polyurethane. In addition, the first inner sheath 220 fills a space between the pair of second electric wires 210 and is provided in such a manner that any gap is not formed in the entire area T, from an outer circumferential surface 210*a* of each second electric wire 210 to the outer circumferential surface 220*a* of the first inner sheath 220, In other words, the first multicore wire 20 is an electric wire with a solid (non-hollowed) structure in which the first inner sheath 220 covers the first twisted pair wire 210A while filling the space between the pair of second electric wires 210. In such solid (non-hollowed) structure, the entire outer circumferential surfaces 210*a* of the pair of second electric wires 210, except a portion where the pair of second electric wires 210 are in contact with each other, are in contact with the first inner sheath 220.

A twist pitch of the first twisted pair wire 210A (hereinafter, also referred to as "first twist pitch") is set by taking into account the outer diameter of the second electric wire 210 so that an unnecessary load is not applied to the second electric wires 210. The first twist pitch here is a distance along the longitudinal direction of the first twisted pair wire 210A between two corresponding points at which a given second electric wire 210 is located at the same position in a circumferential direction of the first twisted pair wire 210A.

(Second Multicore Wire 30)

The third electric wire 310 is constructed of a signal line for the ABS sensor 104*a* mounted on the wheel 102. The second multicore wire 30 is configured to include the second twisted pair wire 310A formed by twisting the pair (i.e., two) of third electric wires 310 together, and a second inner sheath 320 provided to cover the periphery of the second twisted pair wire 310A.

The third electric wire 310 is configured such that a third conductor 311 formed by twisting highly conductive strands of copper, etc., is covered with a third insulation 312 formed of an insulating resin such as cross-linked polyethylene, in the same manner as the second electric wire 210, Strands having a diameter of not less than 0.05 mm and not more than 0.30 mm can be used to form the third conductor 311, in the same manner as the strands used to form the first conductor 11 and the second conductor 211.

The outer diameter of the third electric wire 310 is smaller than the outer diameter of the first electric wire 10. More preferably, the outer diameter of the third electric wire 310 is substantially the same as the second electric wire 210. It is desirable to use the third electric wire 310 which is about half the outer diameter of the first electric wire 10. In particular, it is possible to use the third electric wire 310 which has an outer diameter of not less than 1.0 mm and not more than 1.8 mm and is formed using the third conductor 311 having an outer diameter of not less than 0.4 mm and not more than 1.0 mm.

Furthermore, from the viewpoint of making the outer shape of the composite cable 1 close to a circular shape in cross section, the outer diameter of the second multicore wire 30 is preferably not less than 70% and not more than 160% of the outer diameter of the first electric wire 10. The outer diameter of the second multicore wire 30 is more preferably not less than 85% and not more than 145% of the outer diameter of the first electric wire 10. When, e.g., the outer diameter $R_3$ of the first electric wire 10 is about 3 mm, the outer diameter $R_4$ of the second multicore wire 30 is preferably about not less than 2.10 mm and not more than 4.80 mm (more preferably, not less than 2.55 mm and not more than 4.35 mm).

The second inner sheath 320 has a substantially-cylindrical outer circumferential surface 320*a* and covers the outer surface of the second twisted pair wire 310A, in the same manner as the first inner sheath 220. The second Miner sheath 320 is formed of, e.g., a urethane-based resin such as thermoplastic polyurethane. In addition, the second inner sheath 320 also fills a space between the pair of third electric 310 and is provided in such a manner that any gap is not formed in the entire area T, from an outer circumferential surface 310*a* of each third electric wire 310 to the outer circumferential surface 320*a* of the second inner sheath 320, in the same manner as the first inner sheath 220. In other words, the second multicore wire 30 is an electric wire with a solid (non-hollowed) structure in which the second inner sheath 320 covers the second twisted pair wire 310A while filling the space between the pair of third electric wires 310. In such solid (non-hollowed) structure, the entire outer circumferential surfaces 320*a* of the pair of third electric wires 310, except a portion where the pair of third electric wires 310 are in contact with each other, are in contact with the second inner sheath 320.

A twist pitch of the second twisted pair wire 310A (hereinafter, also referred to as "second twist pitch") is set by taking into account the outer diameter of the electric wire 310 so that an unnecessary load is not applied to the third electric wires 310, in the same manner as the first pitch. In addition, the second twist pitch may be either substantially the same as or different from the first twist pitch, but it is more advantageous than the conventional technique when the second twist pitch is different from the first twist pitch.

(Relation Between the First Multicore Wire 20 and the Second Multicore Wire 30)

The first multicore wire 20 and the second multicore wire 30 are identical. The term "identical" as used herein means that there is no specific difference in attribute information including configuration, dimension and properties, etc., between the first multicore wire 20 and the second multicore wire 30. In more details, "identical" means that the material of the inner sheath, the diameter of the inner sheath, the material of the conductor, the diameter of the conductor, the strand diameter of the conductor and the twist pitch are the same for the both. "The diameter of the conductor, the strand diameter of the conductor and the twist pitch are the same for the both" here not only means completely the same but also means to include a small error (not more than about 5%) which occurs during manufacturing.

(Twisted Assembly 1A)

As shown in FIG. 3, the twisted assembly 1A is formed by twisting the pair of first electric wires 10, the first multicore wire 20 and the second multicore wire 30 together. In the present embodiment, the first electric wires 10 and the first multicore wire 20/the second multicore wire 30 are alternately arranged in a circumferential direction C of the twisted assembly 1A. In other words, the pair of first electric wires 10 are positioned to face each other, and the first multicore wire 20 and the second multicore wire 30 are positioned to face each other.

In further other words, the first multicore wire 20 is arranged in one of regions facing each other across the center plane passing through the central axes O of the pair of first electric wires 10, and the second multicore wire 30 is arranged in the other of the regions. That is, when viewed in the cross section of the composite cable 1, the first multicore wire 20 is arranged on one side of the center line L connecting the centers (see "O") of the pair of first electric wires 10, and the second multicore wire 30 is arranged on the other side of the center line L.

In such arrangement, the first electric wire 10 is in contact with the first multicore wire 20 as well as the second multicore wire 30 on both adjacent sides in the circumferential direction C of the twisted assembly 1A. In addition, the first multicore wire 20 and the second multicore wire 30 are separated from each other by the pair of first electric wires 10 and are arranged at a certain distance from each other. In other words, the first multicore wire 20 and the second multicore wire 30 are arranged so as not to be in direct contact with each other. As a result, even when the first multicore wire 20 and the second multicore wire 30 are used during the same period of time (e.g., during motion of the vehicle), it is possible to prevent crosstalk between the first multicore wire 20 and the second multicore wire 30. In addition, the outer diameter of the first multicore wire 20 and the outer diameter of the second multicore wire 30 are greater than the distance between the pair of first electric wires 10. This prevents one of the first multicore wire 20 and the second multicore wire 30 from moving to the other side by passing through between the pair of first electric wires 10.

The twisted assembly 1A has a substantially elliptical cross-sectional shape with a short diameter $R_1$ and a long diameter $R_2$ ($R_1<R_2$), where the short diameter $R_1$ is the largest outer diameter in a direction of a straight line passing through the centers of the pair of first electric wires 10, and the long diameter $R_2$ is the largest outer diameter in a direction of a straight line passing through the centers of the first multicore wire 20 and the second multicore wire 30. That is, the cross section of the twisted assembly 1A has a substantially elliptical (outer) shape with a minor axis in the vertical direction of FIG. 3 and a major axis in the horizontal direction of FIG. 3. Preferably, the cross-sectional shape of the twisted assembly 1A, i.e., the outer shape of the twisted assembly 1A is a circle ($R_1=R_2$). Note that, in FIG. 3, the cross section of the twisted assembly 1A is depicted as a circle with $R_1=R_2$ for convenience of explanation.

Each of the short diameter $R_1$ and the long diameter $R_2$ of the twisted assembly 1A is, e.g., about 5 mm to 9 mm. A twist pitch of the twisted assembly 1A (hereinafter, also referred to as "third twist pitch") is set by taking into account the outer diameter of the twisted assembly 1A so that an unnecessary load is not applied to the first electric wires 10, the first multicore wire 20 and the second multicore wire 30. The third twist pitch here is a distance along the longitudinal direction of the twisted assembly 1A between two corresponding points at which a given electric wire among the first electric wires 10, the first multicore wire 20 and the second multicore wire 30 is located at the same position in the circumferential direction C of the twisted assembly 1A.

(Tape Member 40)

The tape member 40 is spirally wound around the twisted assembly 1A. The tape member 40 is, e.g., a binding tape. The tape member 40 is in contact with the pair of first electric wires 10, the first multicore wire 20 and the second multicore wire 30. The tape member 40 is provided between the twisted assembly 1A and the outer sheath 50 and reduces friction between the twisted assembly 1A and the outer sheath 50 when bent, thereby serving to improve flex resistance.

The tape member 40 is desirably slidable (desirably has a low friction coefficient) with respect to the first insulation 12, the second insulation 212 and the third insulation 312, and can be formed of, e.g., a non-woven fabric, a paper or a resin (a resin film, etc.). The tape member 40 with a multilayer structure composed of not less than two layers may alternatively be used. The width of the tape member 40 is determined so that the tape member 40 is not creased when the tape member 40 is wound. The tape member 40 does not necessarily need to be spirally wound around the twisted assembly 1A and may be longitudinally wrapped around the twisted assembly 1A.

(Outer Sheath 50)

The outer sheath 50 is provided around the tape member 40. The outer sheath 50 is formed of, e.g., a urethane resin such as thermoplastic polyurethane. Although a shield conductor around the tape member 40 is omitted in the present embodiment since the first electric wires 10 are used to supply a drive current to the EPB motor 101*a* and the drive current flows through the first electric wires 10 in a relatively short time, a shield conductor may be provided between the tape member 40 and the outer sheath 50 or around the outer sheath 50 depending on the intended use, etc., of the first electric wires 10. The shield conductor is formed by, e.g., braiding conductive wires.

(Filler)

The twisted assembly 1A may additionally have plural string-shaped (fibrous) fillers (not shown) extending in the longitudinal direction of the composite cable 1 and may be configured that the fillers are arranged in each gap U formed between the first electric wire 10, the first multicore wire 20 or the second multicore wire 30 and the tape member 40 and are twisted together with the first electric wires 10, the first multicore wire 20 and the second multicore wire 30, By providing the plural tillers, it is possible to make the cross-sectional shape after winding the tape member 40 around the twisted assembly 1A closer to a circular shape. The fillers may be additionally arranged in a valley portion V surrounded by the pair of first electric wires 10, the first multicore wire 20 and the second multicore wire 30.

As the fillers, it is possible to use a fibrous material such as polypropylene yarn, spun rayon yarn (rayon staple fiber), aramid fiber, nylon fiber or fiber plastic, a paper or a cotton yarn.

(Composite Harness Using the Composite Cable 1)

Figure 4:
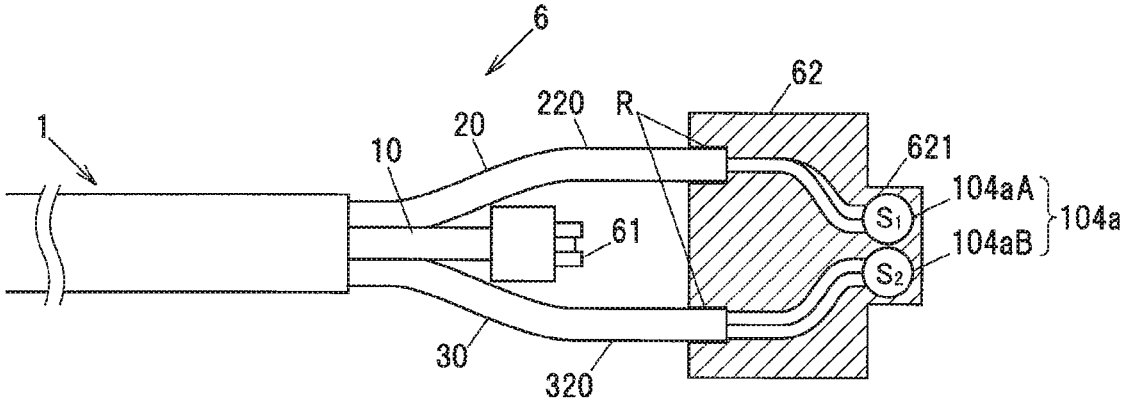
FIG. 4 is a schematic configuration diagram illustrating an exemplary configuration of a composite harness in the embodiment of the invention.

FIG. 4 is a schematic configuration diagram illustrating a composite harness in the present embodiment. As shown in FIG. 4, a composite harness 6 is provided with the composite cable 1 in the present embodiment, a connector 61 attached to an end portion of the first electric wires 10, and a molded member 62 attached to end portions of the first multicore wire 20 and the second multicore wire 30 and formed by molding a resin.

The connector 61 attached to an end portion of the pair of first electric wires 10 is a wheel-side power connector for connection to the EPB motor 101*a*. A first ABS sensor 104*a*A (see "$S_1$" in FIG. 4) is attached to an end portion of the first multicore wire 20, and a second ABS sensor 104*a*B (see "$S_2$" in FIG. 4) is attached to an end portion of the second multicore wire 30. The configuration with the two ABS sensors 104*a*A and 104*a*B increases redundancy of the sensor. Thus, even if one of the first ABS sensor 104*a*A and the second ABS sensor 104*a*B is damaged, the other can still function and it is thereby possible to improve safety of the vehicle.

The first ABS sensor 104*a*A and the second ABS sensor 104*a*B are housed together inside a protruding portion 621 provided on the molded member 62. The protruding portion 621 of the molded member 62 is configured to be fitted to an insertion hole (not shown) which is formed on the ABS device 104 and has a predetermined shape. Such configuration allows two ABS sensors to be put together in one head portion.

In addition, in the present embodiment, the first multicore wire 20 and the second multicore wire 30 are arranged at a distance also inside the molded member 62, such that the molded member 62 covers the periphery (see "R" in FIG. 4) of the first multicore wire 20 and the periphery (see "R" in FIG. 4) of the second multicore wire 30. In such configuration, the molded member 62 is melted and bonded to each of the inner sheaths 220 and 320 (the entire outer circumferential surfaces 220*a* and 320*a*), thereby preventing water ingress into the molded member 62 from between the molded member 62 and the inner sheaths 220 and 320.

Although the connector and the molded member are separately provided on the first electric wire 10 and the first multicore wire 20/the second multicore wire 30 in this example, one dedicated connector connecting these electric wires all together may be provided.

(Modification of the Composite Harness 6)

Figure 5:
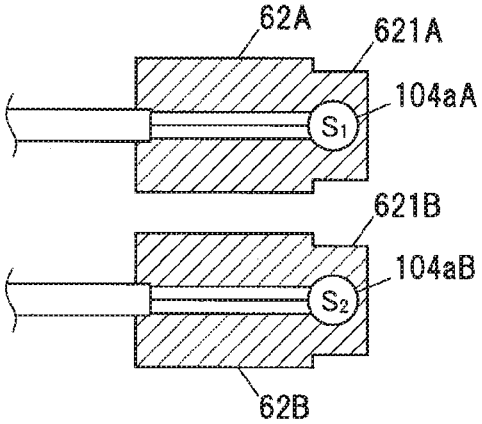
FIG. 5 is a schematic configuration diagram illustrating an exemplary configuration of the composite harness in a modification of the invention.

FIG. 5 is a schematic configuration diagram illustrating an exemplary configuration of the composite harness in a modification of the invention. As shown in FIG. 5, separate molded resin portions may be respectively provided on the first multicore wire 20 and the second multicore wire 30, In detail, the composite harness in the present modification is provided with a first molded member 62A which covers the first multicore wire 20 and the first ABS sensor 104*a*A together, and a second molded member 62B which is provided at a distance from the first molded member 62A and covers the second multicore wire 30 and the second ABS sensor 104*a*B together.

The first molded member 62A has a first protruding portion 621A which houses the first ABS sensor 104*a*A. The second molded member 62B has a second protruding portion 621B which houses the second ABS sensor 104*a*B. The first molded member 62A and the second molded member 62B may alternatively be integrated by connecting end portions thereof (e.g., the tip portions on the ABS sensors 104*a*A and 104*a*B side). The first protruding portion 621A and the second protruding portion 621B are configured to be respectively fitted to a first insertion hole (not shown) and a second insertion hole (not shown) which are formed on the ABS device 104.

(Functions and Effects of the Embodiment)

Since the first multicore wire 20 and the second multicore, wire 30 have a solid (non-hollowed) structure and are respectively arranged on one side and the other side of the center plane passing through the central axes O of the pair of first electric wires 10, it is possible to prevent change in the outer shape of the twisted assembly 1A along the longitudinal direction of the composite cable 1 even when the twist pitch of the first twisted pair wire 210A (the first twist pitch) and the twist pitch of the second twisted pair wire 310A (the second twist pitch) are different in the configuration in which two rotational speed sensors are provided to have redundancy. Since the first multicore wire 20 and the second multicore wire 30 have a solid (non-hollowed) structure, change in the shape of the first inner sheath 220 and the second inner sheath 320 due to pressure during extrusion molding can be prevented at the time of extruding the outer sheath 50 around the twisted assembly 1A. This allows for further prevention of change in the outer shape of the twisted assembly 1A along the longitudinal direction of the composite cable 1.

In addition, since the change in the outer shape of the twisted assembly 1A along the longitudinal direction of the composite cable 1 is prevented, non-uniformity of the thickness of the outer sheath 50 along the circumferential direction C of the twisted assembly 1A can be prevented at any positions in the longitudinal direction of the composite cable 1. This improves terminal processability of the composite cable 1. If the outer sheath 50 has a large non-uniformity in thickness, the outer sheath 50 may not be sufficiently cut at some portions when cutting the outer sheath 50 to terminate composite cable 1. When some portions of the outer sheath 50 are not sufficiently cut, it may be difficult to strip the outer sheath 50 froth the twisted assembly 1A. According to the twisted assembly 1A of the invention, it is possible to prevent such difficulty and thereby improve terminal processability of the composite cable 1.

Although the embodiment of the invention has been described, the invention according to claims is not to be limited to the embodiment described above. Further, please note that all combinations of the features described in the embodiment are not necessary to solve the problem of the invention.

The invention claimed is:

1. A composite cable, comprising:

a pair of first single core wires;

a first multicore wire that is arranged in one of regions facing each other across a center plane passing through the central axes of the pair of first single core wires, comprises an electric wire with a solid (non-hollowed) structure comprising a first twisted pair wire formed by twisting a pair of second single core wires with a smaller cross-sectional area than the first single core wire and a first inner sheath comprising resin, having a circular outer cross section and covering the first twisted pair wire so as to fill a space between the pair of second single core wires, and has an outer diameter that is not less than 70% and not more than 160% of the outer diameter of the first single core wire; and a second multicore wire that is arranged in the other of the regions facing each other across the center plane passing through the central axes of the pair of first single core wires, comprises an electric wire with a solid (non-hollowed) structure comprising a second twisted pair wire formed by twisting a pair of third single core wires with a smaller cross-sectional area than the first single core wire and a second inner sheath comprising resin, having a circular outer cross section and covering the second twisted pair wire so as to fill a space between the pair of third single core wires, and has an outer diameter that is not less than 70% and not more than 160% of the outer diameter of the first single core wire, wherein a twisted assembly is formed by twisting the pair of first single core wires, the first multicore wire and the second multicore wire together.

2. The composite cable according to claim 1, wherein the pair of second single core wires and the pair of the third single core wires comprise signal lines for rotational speed sensors that detect a rotational speed, and the rotational speed sensors are respectively attached to end portions of the pair of second single core wires and the pair of the third single core wires.

3. The composite cable according to claim 1, wherein a binding tape is provided around the twisted assembly.

4. The composite cable according to claim 3, wherein an outer sheath is provided around the binding tape.

5. The composite cable according to claim 1, wherein, the first single core wire comprises a conductor formed by twisting a plurality of equal-diameter strands together.

6. The composite cable according to claim 1, wherein the outer diameter of the first multicore wire and the outer diameter of the second multicore wire are not less than 85% and not more than 145% of the outer diameter of the pair of first single core wire.

7. The composite cable according to claim 1, wherein the first multicore wire and the second multicore wire are identical.

8. A composite harness, comprising: the composite cable according to claim 1; and a connector attached to an end portion of the pair of first single core wires.

9. The composite harness according to claim 8, wherein the first multicore wire and the second multicore wire are arranged at a distance from each other.

* * * * *